US011415318B2

(12) United States Patent
Beyrodt

(10) Patent No.: US 11,415,318 B2
(45) Date of Patent: *Aug. 16, 2022

(54) FIRE STARTER

(71) Applicant: Beyrodts Best LLC, Norfolk, VA (US)

(72) Inventor: Michael D. Beyrodt, Norfolk, VA (US)

(73) Assignee: BEYRODTS BEST LLC, Norfolk, VA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/852,033

(22) Filed: Apr. 17, 2020

(65) Prior Publication Data

US 2020/0378601 A1 Dec. 3, 2020

Related U.S. Application Data

(63) Continuation of application No. 15/954,082, filed on Apr. 16, 2018, now Pat. No. 10,641,485, which is a (Continued)

(51) Int. Cl.

*C10L 11/04* (2006.01)
*C10L 11/06* (2006.01)

(Continued)

(52) U.S. Cl.

CPC ..... *F23Q 2/18* (2013.01); *C10L 11/04* (2013.01); *C10L 11/06* (2013.01); *F23Q 1/06* (2013.01);

(Continued)

(58) Field of Classification Search

CPC ..... C10L 11/04; C10L 11/06; C10L 11/08; C10L 2200/0453; C10L 2200/0469; C10L 2230/06; F23Q 1/06; F23Q 2/18

See application file for complete search history.

(56) References Cited

U.S. PATENT DOCUMENTS 1,401,803 A 12/1921 Lynes
3,515,525 A * 6/1970 Fearon ..... C10L 11/04 44/533

(Continued)

FOREIGN PATENT DOCUMENTS

FR 2 698 100 A1 5/1994
GB 2235209 2/1991

OTHER PUBLICATIONS

Canadian Office Action dated Jun. 2, 2022, for Canadian pat. appl. No, 2,958,441, 4 pages.

*Primary Examiner* — Ellen M McAvoy
*Assistant Examiner* — Ming Cheung Po

(57) ABSTRACT

A fire starter includes a casing made from a first material a first material having a first time associated therewith that defines a length of time that the casing burns after being ignited. A second material disposed in the casing has a second time associated therewith that defines a length of time that the second material burns after being ignited. An igniter, disposed in the casing and adjacent to the second material, generates a first thermal event to ignite the second material wherein the second material combusts to define a second thermal event that ignites the first material. An actuator is coupled to the igniter and is positioned outside of the casing for activating the igniter to generate the first thermal event.

20 Claims, 3 Drawing Sheets

Related U.S. Application Data continuation of application No. 15/453,474, filed on Mar. 8, 2017, now Pat. No. 9,945,559, which is a continuation of application No. 15/149,513, filed on May 9, 2016, now Pat. No. 9,933,160.

(60) Provisional application No. 62/163,064, filed on May 18, 2015.

(51) Int. Cl.

| | |
|---|---|
| ***C10L 11/08*** | (2006.01) |
| ***F23Q 2/18*** | (2006.01) |
| ***F23Q 1/06*** | (2006.01) |
| ***F23Q 3/00*** | (2006.01) |

(52) U.S. Cl.

CPC ..... *F23Q 3/00* (2013.01); *C10L 2200/025* (2013.01); *C10L 2200/0259* (2013.01); *C10L 2200/0263* (2013.01); *C10L 2200/0453* (2013.01); *C10L 2200/0469* (2013.01); *C10L 2230/06* (2013.01)

(56) References Cited

U.S. PATENT DOCUMENTS

| | | | | | |
|---|---|---|---|---|---|
| 3,566,857 | A * | 3/1971 | Price | A47J 36/30 | 126/262 |
| 4,583,940 | A * | 4/1986 | Zellweger | F23Q 1/02 | 431/269 |
| 4,762,525 | A * | 8/1988 | Wood | C10L 5/368 | 126/9 A |
| 4,832,703 | A * | 5/1989 | Campana | C10L 11/04 | 44/519 |
| 5,186,721 | A * | 2/1993 | Campana | C10L 11/04 | 44/519 |
| 5,552,001 | A | 9/1996 | Fearon | | |
| 5,743,248 | A | 4/1998 | Jansen, Jr. | | |
| 6,558,440 | B1 | 5/2003 | Price, Jr. | | |
| 7,670,392 | B2 * | 3/2010 | Correa | C10L 5/36 | 44/530 |
| 8,597,381 | B2 | 12/2013 | Paapsi | | |
| 9,933,160 | B2 * | 4/2018 | Beyrodt | C10L 11/04 | |
| 9,945,559 | B2 | 4/2018 | Beyrodt | | |
| 10,641,485 | B2 | 5/2020 | Beyrodt | | |
| 2009/0159073 | A1 | 6/2009 | Giordano | | |
| 2011/0262874 | A1 | 10/2011 | Kraminer | | |

* cited by examiner

FIRE STARTER

CROSS REFERENCE TO RELATED APPLICATIONS

This application is a continuation of U.S. application Ser. No. 15/954,082, filed Apr. 16, 2018, now U.S. Pat. No. 10,641,485, titled "Fire Starter," which is a continuation of U.S. application Ser. No. 15/453,474, filed Mar. 8, 2017, now U.S. Pat. No. 9,945,559, titled "Fire Starter," which is a continuation of U.S. application Ser. No. 15/149,513, filed May 9, 2016, now U.S. Pat. No. 9,933,160, titled "Fire Starter," which is non-provisional of and claims priority to U.S. provisional application Ser. No. 62/163,064, filed May 18, 2015, titled "Pull Start Fire." The aforementioned applications are all herein expressly incorporated by reference in their entirety.

FIELD OF THE INVENTION

The invention relates generally to fire starting apparatus, and more particularly to a self-contained fire starter.

BACKGROUND

Traditional methods of starting a fire in an outdoor environment can be time-consuming and unreliable. Typically, one starts a fire by placing dry kindling wood and paper below a stack of logs or charcoal. The paper is ignited and, if all goes well, the stack of logs eventually ignites. However, the success of traditional methods depends on a number of factors, including weather conditions, the amount and condition of combustible materials used, and the experience of the user. Consequently, alternative methods of starting fires have been proposed which are relatively unaffected by weather conditions, do not require the use of paper or kindling wood, and require little or no skill to use.

Alternative fire starting methods generally involve the use of either liquid-fuel or solid-fuel fire starters. Liquid-fuel fire starters have the disadvantage of being highly flammable and are subject to flashbacks, making them more dangerous to store and use than solid fuels. Solid-fuel fire starters are commonly blocks of paraffin wax mixed with a cellulose material such as sawdust or woodchips. The blocks are placed on a support located below a stack of wood, charcoal, etc., and are ignited using a manually-held flame source such as a match or lighter thereby requiring the user to have at least his hand in proximity to the fire area. Solid-fuel fire starters can also be wrapped in a flammable bag that the user lights to, in turn, light the solid fuel. However, all solid-fuel fire starters are subject to a user's ability to hold a match or lighter up to the fire starter long enough to allow the flammable bag and/or the solid fuel to combust. This requirement can present significant challenges when in a windy outdoor environment.

SUMMARY

Accordingly, it is an object of the present invention to provide a fire starter.

Another object of the present invention is to provide a fire starter that is safe to use.

Still another object of the present invention is to provide a fire starter for use in outdoor environments.

Yet another object of the present invention is to provide a fire starter that requires no externally-applied flame for activation.

A still further object of the present invention is to provide a fire starter that is fully self-contained.

Other objects and advantages of the present invention will become more obvious hereinafter in the specification and drawings.

In accordance with the present invention, a fire starter includes a casing made from a first material having a first time associated therewith that defines a length of time that the casing burns after being ignited. A second material disposed in the casing has a second time associated therewith that defines a length of time that the second material burns after being ignited. The second time is less than the first time. An igniter, disposed in the casing and adjacent to the second material, generates a first thermal event to ignite the second material wherein the second material combusts to define a second thermal event that ignites the first material. An actuator is coupled to the igniter and is positioned outside of the casing for activating the igniter to generate the first thermal event.

BRIEF DESCRIPTION OF THE DRAWINGS

Other objects, features and advantages of the present invention will become apparent upon reference to the following description of the preferred embodiments and to the drawings, wherein corresponding reference characters indicate corresponding parts throughout the several views of the drawings and wherein.

DETAILED DESCRIPTION

Figure 1:
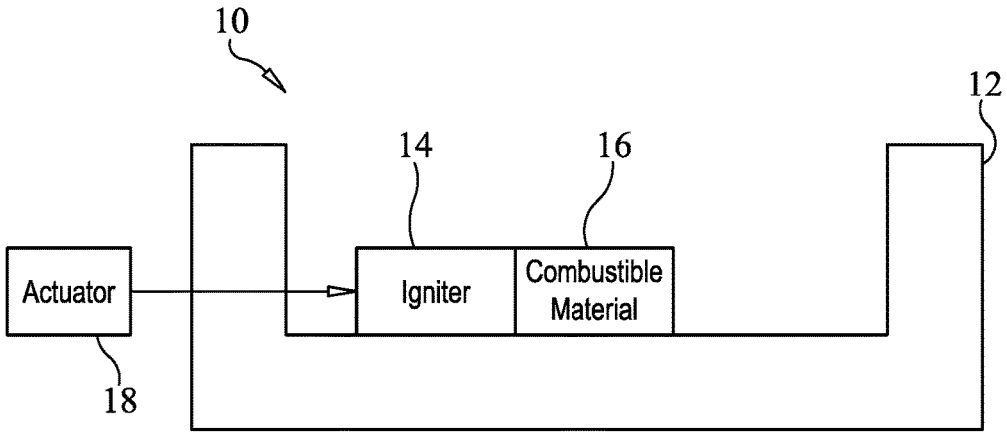
FIG. 1 is a schematic view of a fire starter in accordance with an embodiment of the present invention.

Referring now to the drawings and more particularly to FIG. 1, a fully self-contained fire starter in accordance with an embodiment of the present invention is shown and is referenced generally by numeral 10. Fire starter 10, as well as all other embodiments of the present invention described and/or illustrated herein, is self-contained in that no external source of thermal energy is required to initiate combustion. Rather, the fire starter need only be placed in a fire starting location and activated by a simple and non-thermal manual activity to initiate combustion. While the fire starter can be used in indoor and outdoor environments, a great advantage of the present invention is that the fire starter will work even in very windy, outdoor environments.

The fire starter of the present invention is a novel arrangement of elements that, when activated, produce a plurality of thermal events with the last thermal event being an enduring flame suitable for starting a fire in a stack of wood, charcoal, etc. In terms of fire starter 10, the elements include an outer casing 12, an igniter 14 disposed in casing 12, a combustible material 16 disposed in casing 12 adjacent to igniter 14, and an actuator 18 coupled to igniter 14 and positioned outside of casing 12. While the overall size of fire starter 10 is not a limitation of the present invention, the entirety of fire starter 10 can generally be a hand-held structure.

Casing 12 is made from a combustible material that provides the fuel for the final thermal event (i.e., a fire-starting enduring flame) for an activated fire starter 10. In general, casing 12 is made from a solid material that, once ignited, will burn for a sufficient period of time to ignite surrounding wood, charcoal, etc. that is adjacent to a burning casing 12. A suitable material choice for casing 12 is a mixture of paraffin wax and a cellulose material such as sawdust, woodchips, etc. The ratio of paraffin wax to cellulose material can be "one-to-one" or "greater-than-one to one" without departing from the scope of the present invention. In general, flame height will increase but the flame's life span will decrease with increasing amounts of paraffin wax. Accordingly, the ratio of paraffin wax to cellulose material can be tailored to suit a product's application. By way of example, a ratio of paraffin wax to cellulose material of approximately 1.5 to 1 provides a good balance between flame height and life span for most indoor and outdoor applications. For example, when casing 12 is constructed with this ratio and such that it can be hand-held, the burning life span of casing 12 can easily be in the range of approximately 20 minutes to approximately 60 minutes.

Casing 12 can be formed or constructed to define a well or an internal chamber in which igniter 14 and combustible material 16 are disposed. As will be explained further below, if casing 12 forms part of, or all of, a chamber that houses igniter 14 and combustible material 16, vent holes (not shown) can be provided to admit outside air to flow into the chamber. Casing 12 can be a unitary body or could be assembled arrangement of casing portions without departing from the scope of the present invention.

Combustible material 16 is the fuel for a thermal event that will trigger the combustion of casing 12. In general, the thermal event created when combustible material 16 combusts must last long enough to ignite casing 12 to combustion. To assure efficient combustion of combustible material 16 even in a low-level oxygen environment, an oxidizer can be included in combustible material 16. When casing 12 forms part of, or all of, an internal chamber housing combustible material 16, the inclusion of an oxidizer in combustible material 16 is particularly beneficial. The length of time that combustible material 16 must burn will generally be less than the burn time associated with casing 12. By way of example, when casing 12 is made from the above-described mixture of paraffin wax and cellulose material, combustible material 16 can be a mixture of materials capable of burning for a time in the range of approximately 50 seconds to approximately 95 seconds. Such mixtures can be readily found in road flare technologies where such mixtures generally include the following materials noted with a range of weight percent:

| Material | Weight Percent |
|---|---|
| Strontium nitrate | 67-78% |
| Potassium nitrate | 2-11% |
| Sulfur | 6-15% |
| Polyvinyl chloride | 1-10% |

-continued

| Material | Weight Percent |
|---|---|
| Paraffin oil | 1-4% |
| Sawdust | 0-2% |

Note that potassium nitrate defines the oxidizer in these types of mixtures.

Igniter 14 is positioned adjacent to combustible material 16. In general, igniter 14 is capable of generating a thermal event that triggers the combustion of combustible material 16. That is, the thermal event produced by igniter 14 must last long enough to ignite combustible material 16. Depending on the material used for combustible material 16, the thermal event provided by igniter 14 (when activated) could be a spark, a small burn event (e.g., a burning fuse), a chemical reaction, etc. By way of example, when using the above-noted mixtures for combustible material 16, igniter 14 needs to provide a small burn event having a burn time in the range of approximately 4 second to approximately 5 seconds.

Actuator 18 is coupled to igniter 14 but is positioned outside of casing 12. In general, actuator 18 is a manually-operated element that activates igniter 14 such that igniter 14 produces the igniter's above-described thermal event. As mentioned above, the manual operation applied to actuator 18 does not include or require the application of any external source of thermal energy. Actuator 18 can be realized by a structure that is manually pulled or manually pushed where such action activates igniter 14.

Figure 2:
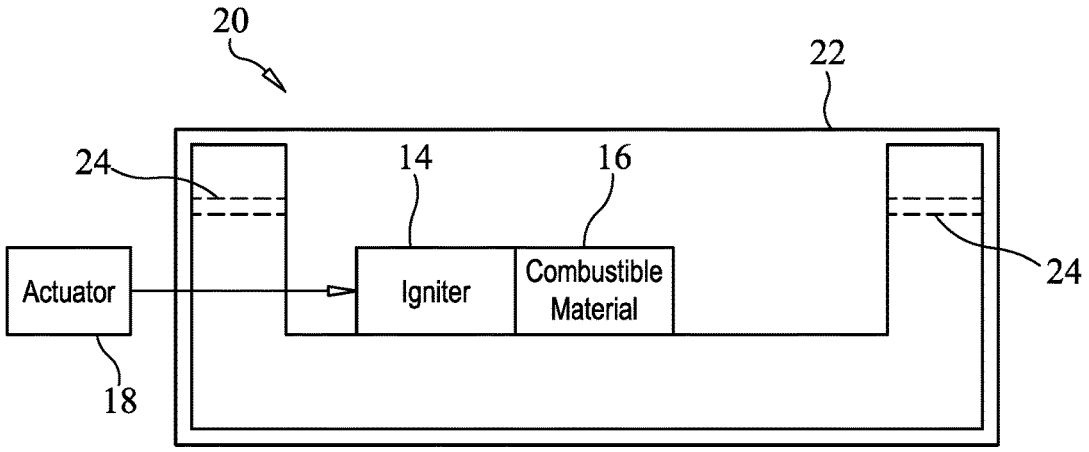
FIG. 2 is a schematic view of a fire starter with a paper overwrap in accordance with another embodiment of the present invention.

Another embodiment of a fire starter in accordance with the present invention is illustrated in FIG. 2 and is referenced generally by numeral 20. Fire starter 20 includes the elements of fire starter 10, and further includes an overwrapping of paper 22 that can improve the fire starter's performance in a windy environment, provide a base for the printing of use instructions, protect casing 12, etc. When paper overwrap 22 is used, it can be beneficial to provide vent holes 24 in casing 12 where each vent hole 24 provides a fluid (air) communication path between the air surrounding combustible material 16 and the air outside of casing 12. Paper overwrap 22 is selected such that, when combustible material 16 burns, paper overwrap 22 readily ignites thereby making air available at the external surfaces of casing 12 for passage through vent holes 24. For example, paper overwrap 22 can be made using standard 20 pound paper. The air available via vent holes 24 improves the combustion efficiency of combustible material 16.

Figure 3:
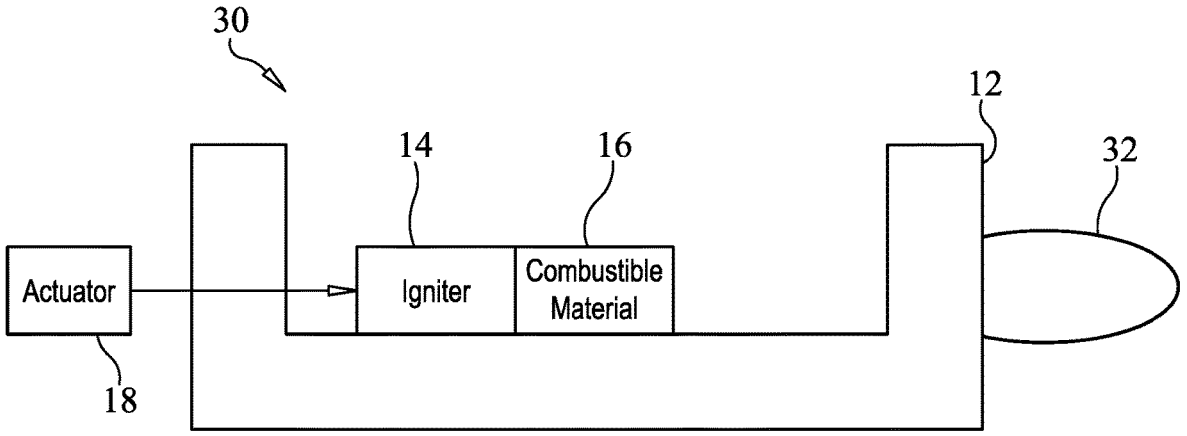
FIG. 3 is a schematic view of a fire starter with an anchoring loop in accordance with another embodiment of the present invention.

Another embodiment of the present invention is illustrated in FIG. 3 and is referenced generally by numeral 30. Fire starter 30 includes the elements of fire starter 10 (and can include one or more of the additional features of fire starter 20), and further includes an anchoring line 32 extending from casing 12. Anchoring line 32 can define a loop as shown that facilitates attachment of fire starter 30 to a piece of wood, log, etc., in a material stack (not shown) that is to be ignited by fire starter 30.

Figure 4:
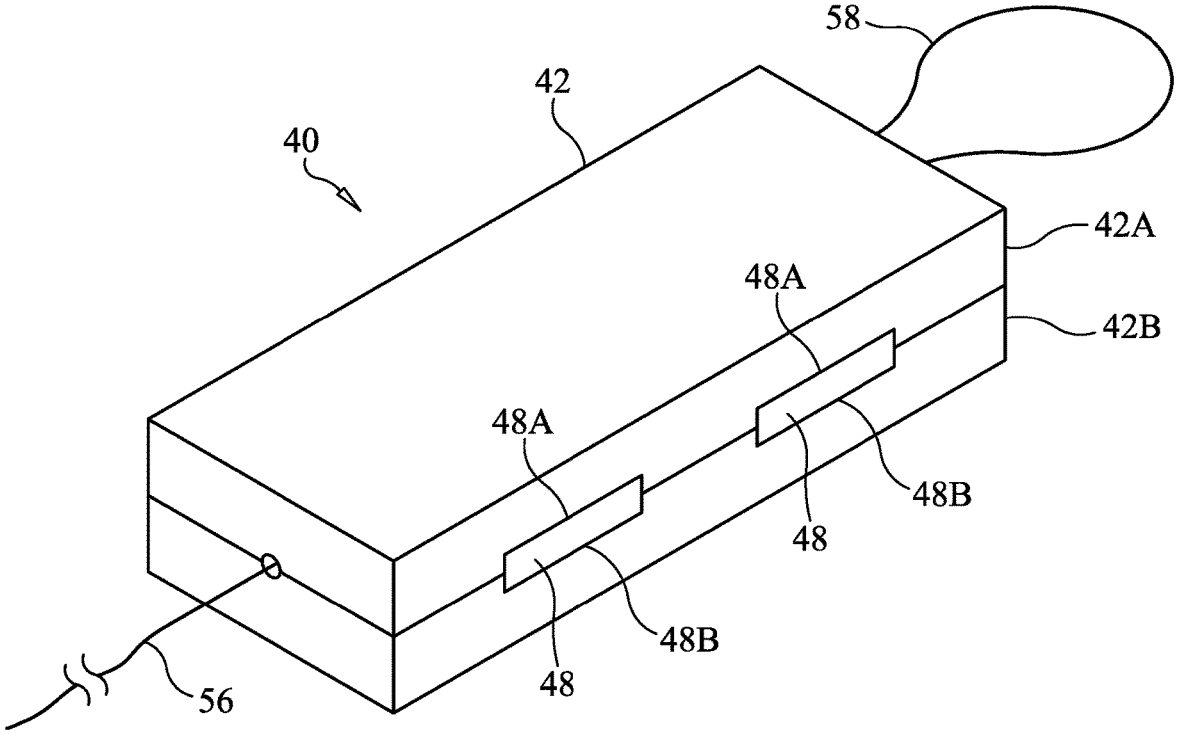
FIG. 4 is a perspective view of a fire starter having a pull string activator and anchoring loop in accordance with an embodiment of the present invention.
Figure 5:
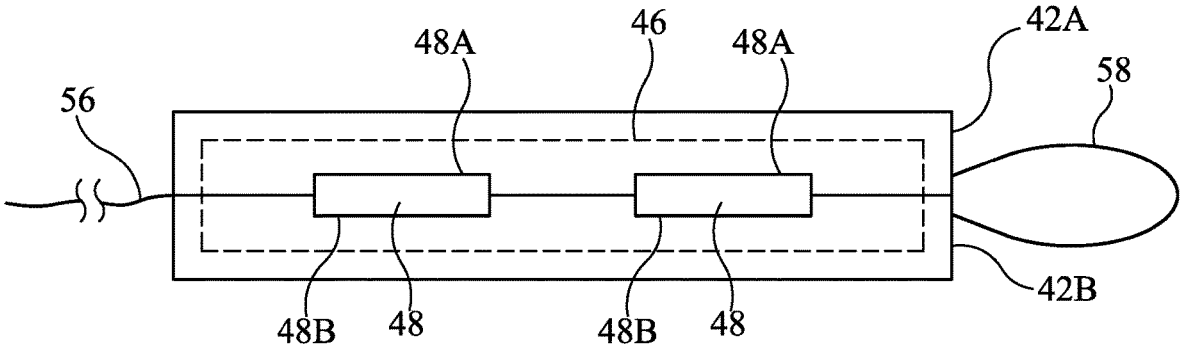
FIG. 5 is a side view of the fire starter depicted in FIG. 4.
Figure 6:
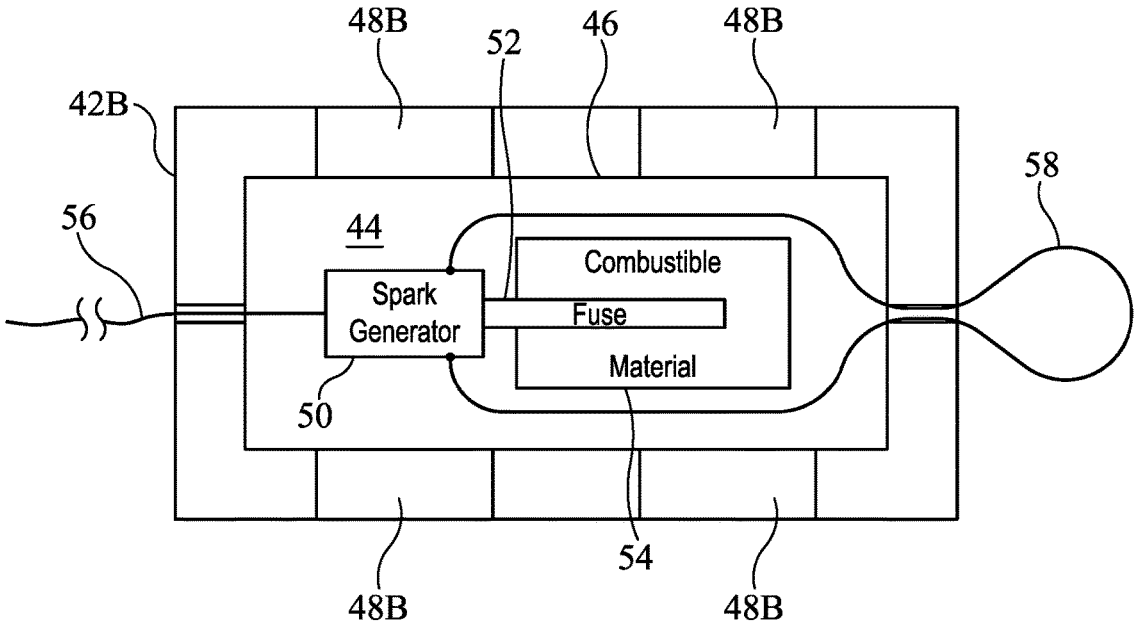
FIG. 6 is a plan view of the lower half of the FIG. 4 fire starter's casing illustrating the components disposed therein in accordance with an embodiment of the present invention.

An exemplary embodiment of the present invention will be described with simultaneous reference to FIGS. 4-6 where the fire starter is referenced generally by numeral 40. Fire starter 40 includes a casing 42 made from identical top and bottom clam shell portions 42A and 42B, respectively. Casing 42 has the same material and combustion attributes as casing 12. Each clam shell portion 42A and 42B includes a well region 44 (visible for portion 42B in FIG. 6) such that, when portions 42A and 42B are positioned against one another in a mirror-image fashion, the two well regions join to define a chamber 46 (visible in FIG. 5) in casing 42.

Channels 48A/48B are defined in portions 42A/42B such that a corresponding plurality of vent holes 48 are defined in casing 42 when portions 42A and 42B are positioned against one another. Each vent hole 48 defines a fluid communication path between the outside of casing 42 and chamber 46.

Disposed in well region 44 (FIG. 6), that will become part of chamber 46 when casing portions 42A and 42B are positioned against one another, are a spark generator 50, a fuse 52 coupled to spark generator 50 and extending therefrom, and a combustible material 54 in contact with fuse 52. The combination of a spark generator 50 and fuse 52 have the same combustion attributes of previously-described igniter 14. Spark generator 50 can be a variety of mechanically-activated friction-type sparking devices such as, but not limited to, pull-type spark generators (also known as "poppers") and push-type spark generators used in conventional gas grills. Fuse 52 can be any conventional fuse or primer cord that combusts to define a short-term burn event (e.g., on the order of approximately 4-5 seconds) when exposed to a spark. Combustible material 54 has the same material and combustion attributes as previously-described combustion material 16.

Fire starter 40 also includes an actuator 56 coupled to spark generator 50. By way of an illustrative example, if spark generator 50 is a pull-type device, actuator 56 can be a line/string coupled to spark generator 50 and extended through casing 42 to be accessible on the outside of casing 42. An anchoring line 58 can be attached to spark generator 50 (or casing 42) and extended though casing 42 to be accessible as a loop on the outside of casing 42. Anchoring line 58 has the attributes and function of previously-described anchoring line 32. By attaching anchoring line 58 to spark generator 50, a pulling/activating force applied to actuator 56 does not get transferred to casing 42. By isolating casing 42 from the pulling/activating force, casing 42 is not subject to tensile stresses. Isolating casing 42 from tensile stresses is important when casing 42 is made from a mixture of paraffin wax and cellulose material, i.e., a material that does not possess high tensile strength.

Figure 7:
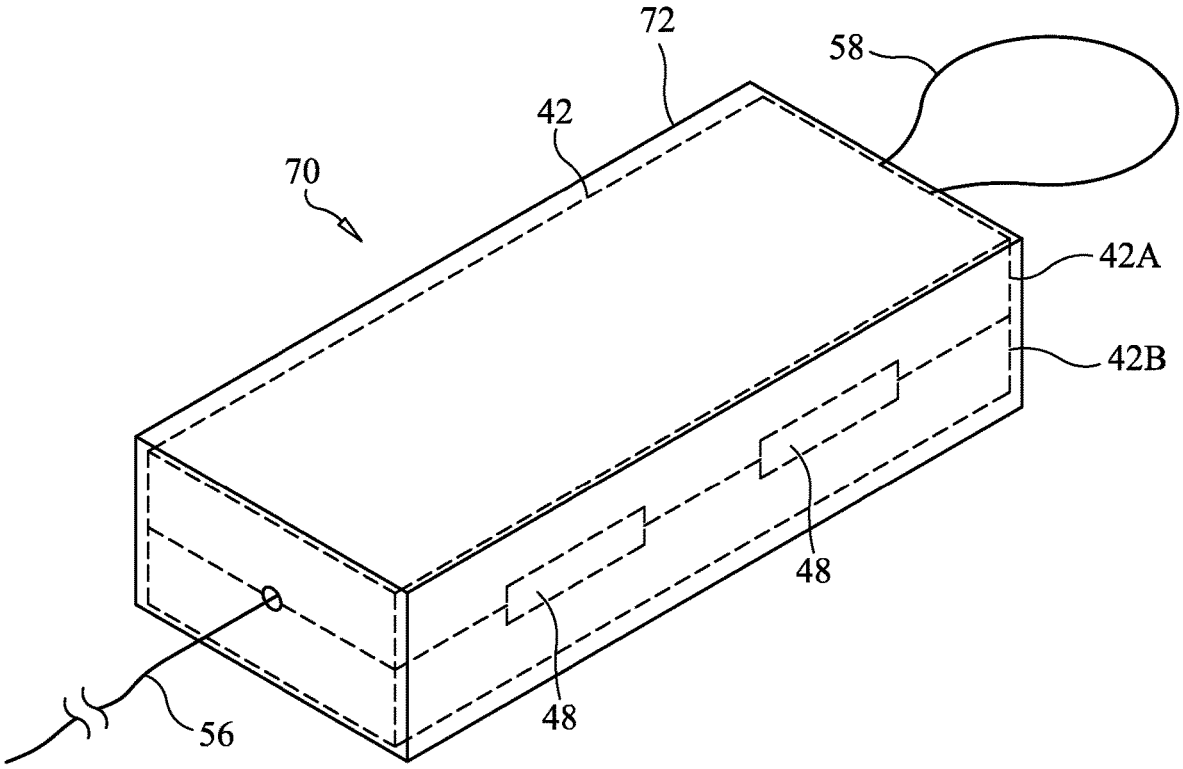
FIG. 7 is a perspective view of a fire starter with a paper overwrap in accordance with another embodiment of the present invention.

A further embodiment of the present invention is illustrated in FIG. 7 and is referenced generally by numeral 70. Fire starter 70 includes the elements of fire starter 40, and further includes an overwrapping of paper 72 to provide the same benefits of previously-described paper overwrap 22.

The advantages of the present invention are numerous. The fire starter does not require any externally-supplied source of thermal energy so that no matches, lighters, etc., are needed for its use. The fire starter is completely self-contained with its igniting thermal event devices being protected from wind thereby assuring its effectiveness in hostile outdoor environments. The fire starter's chain of thermal events for starting a fire is triggered by a single and simple mechanical action. At the same time, since the mechanical activation of the fire starter requires a purposeful event, the chance of its inadvertent ignition is greatly reduced or minimized.

Although the invention has been described relative to specific embodiments thereof, there are numerous variations and modifications that will be readily apparent to those skilled in the art in light of the above teachings. It is therefore to be understood that, within the scope of the appended claims, the invention may be practiced other than as specifically described.

What is claimed is:

1. A fire starter, comprising:

a casing defining an interior chamber and having a first side portion and a second side portion opposite the first side portion, the casing being made from a first burnable material;

a second burnable material disposed in the interior chamber of the casing;

an igniter disposed in the interior chamber of the casing and configured to generate a first thermal event to ignite the second burnable material, the second burnable material combusts during the first thermal event to define a second thermal event to ignite the first burnable material;

an actuator coupled to the igniter, the actuator configured to activate the igniter to generate the first thermal event; and an anchor line coupled to the igniter, a first portion of the anchor line being disposed within the interior chamber, the first portion of the anchor line being coupled to the igniter at a first attachment location and a second attachment location different from the first attachment location, a second portion of the anchor line being disposed outside of the casing.

2. The fire starter of claim 1, wherein the anchor line defines a loop, a first portion of the loop is defined by the first portion of the anchor line, a second portion of the loop is defined by the second portion of the anchor line, at least a portion of the second burnable material is disposed within the first portion of the loop, the second portion of the loop is sized and configured to be placed around a structure exterior to the casing to anchor the apparatus when the actuator is actuated.

3. The fire starter of claim 1, wherein the anchor line is flexible, the anchor line limits movement of the igniter in a first direction when actuator is moved in the first direction.

4. The fire starter of claim 1, wherein the igniter includes:

a spark generator; and a fuse coupled to the spark generator and in contact with the second burnable material.

5. The fire starter of claim 1, wherein:

the igniter includes a spark generator and a fuse coupled to a first end of the spark generator, and the actuator is coupled to a second end of the spark generator different from the first end.

6. The first starter of claim 1, wherein the first attachment location is on a first side of the igniter and the second attachment location is on a second side of the igniter opposite the first side.

7. The fire starter of claim 1, wherein the actuator includes a line or string that is pulled to activate the igniter.

8. The fire starter of claim 1, wherein the casing defines a plurality of vent holes extended between the interior chamber and an exterior of the casing.

9. The fire starter of claim 1, wherein the first burnable material includes a mixture of paraffin wax and pieces of a cellulose material.

10. The fire starter of claim 1, wherein the second burnable material includes an oxidizer.

11. An apparatus, comprising:

a casing defining an interior chamber and being made from a first material that combusts when exposed to a flame;

a spark generator disposed in the interior chamber of the casing to generate a spark when the spark generator is activated;

a fuse disposed in the interior chamber of the casing, the fuse coupled to the spark generator and extending therefrom, the fuse combusting to define a burning fuse for a time when exposed to the spark;

a second material disposed in the interior chamber of the casing and adjacent the fuse, the second material combusting, when the second material is exposed to the burning fuse, to define the flame;

an actuator coupled to the spark generator and having at least a portion that is positioned outside of the casing and that is configured to be pulled in a first direction to activate the spark generator; and an anchor line coupled to the spark generator at a plurality of attachment locations, the anchor line having a portion disposed outside the casing, the anchor line configured to be coupled to an anchor exterior to the apparatus such that the anchor line limits movement of the spark generator in the first direction when the portion of the actuator is pulled in the first direction to activate the spark generator.

12. The apparatus of claim 11, wherein the portion of the anchor line disposed outside the casing is a first portion, the anchor line has a second portion disposed in the interior chamber of the casing such that at least a portion of the second material is disposed within an interior region defined by the second portion of the anchor line.

13. The apparatus of claim 11, wherein:

the fuse is coupled to a first end of the spark generator, and the actuator is coupled to a second end of the spark generator different from the first end.

14. The apparatus of claim 11, wherein the plurality of attachment locations includes a first attachment location on a first side of the spark generator and a second attachment location on a second side of the spark generator opposite the first side.

15. The apparatus of claim 11, wherein the first material includes a mixture of paraffin wax and pieces of a cellulose material.

16. The apparatus of claim 11, wherein the second material includes an oxidizer.

17. The apparatus of claim 11, wherein the casing defines vent holes that are extended between the interior chamber and an exterior of the casing.

18. The apparatus of claim 11, wherein:

the anchor line includes a loop sized and configured to be placed around a structure exterior to the apparatus, and the portion of the actuator and the loop are disposed at opposing ends of the casing.

19. The apparatus of claim 11, wherein a portion of the fuse extended from the spark generator is disposed within the second material.

20. The apparatus of claim 11, wherein:

the first material burns for a length of time after being ignited, the second material burns for a length of time after being ignited, and the length of time associated with the second material is less than the length of time associated with the first material.

* * * * *